US006223434B1

(12) United States Patent
Morikawa

(10) Patent No.: US 6,223,434 B1
(45) **Date of Patent: *May 1, 2001**

(54) MUFFLER AND ITS MANUFACTURING METHOD

(75) Inventor: Akinobu Morikawa, Nishikamo-Gun (JP)

(73) Assignee: Sango Co., Ltd., Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/355,616

(22) PCT Filed: Apr. 1, 1998

(86) PCT No.: PCT/JP98/01504

§ 371 Date: Jul. 30, 1999

§ 102(e) Date: Jul. 30, 1999

(87) PCT Pub. No.: WO98/44247

PCT Pub. Date: Oct. 8, 1998

(30) Foreign Application Priority Data

Apr. 2, 1997 (JP) ..... 9-083464

(51) Int. Cl.[7] ..... B23P 17/00
(52) U.S. Cl. ..... 29/890.08; 181/248
(58) Field of Search ..... 181/247, 248, 181/249, 255, 282; 29/890.08

(56) References Cited

U.S. PATENT DOCUMENTS 4,993,513 * 2/1991 Inoue et al. ..... 181/282
5,100,047 * 3/1992 Nakagawa et al. ..... 29/890.08
5,293,743 3/1994 Usleman et al. .

FOREIGN PATENT DOCUMENTS 51-028572 3/1976 (JP) .
57-206538 12/1982 (JP) .
2-19820 2/1990 (JP) .
2-137516 11/1990 (JP) .
3-146617 6/1991 (JP) .
4-190919 7/1992 (JP) .
5-280323 10/1993 (JP) .
7-019201 1/1995 (JP) .
7-042546 2/1995 (JP) .
7-310520 11/1995 (JP) .

* cited by examiner

*Primary Examiner*—Khanh Dang
(74) *Attorney, Agent, or Firm*—Pillsbury Winthrop LLP

(57) ABSTRACT

A muffler is constructed by inner and outer pipes, in which opposite end portions of the outer pipe are reduced in diameter, a welding portion of the inner pipe is accurately formed, and in this muffler, in order that a welding portion of the inner pipe can be accurately formed and that the outer pipe can be reduced in diameter uniformly over an entire periphery thereof to compress a buffer member uniformly over an entire periphery thereof, the inner pipe (2), having the buffer member (8) fitted on one end portion 2*a* thereof, is held within the outer pipe (1), held in position, in such a manner that a predetermined gap is formed between the inner and outer pipes (2) and (1). Subsequently, a diameter of the other end portion (1*b*) of the outer pipe (1) remote from the buffer member (8) is reduced, thereby fixedly securing this other end portion to the other end portion 1*b* of the inner pipe (2). Subsequently, a spinning processing is applied to one end portion (1*a*) of the outer pipe (1), thereby reducing a diameter of this one end portion until this one end portion (2*a*) is brought into contact with the buffer member (8), and further radially compresses the buffer member (8).

4 Claims, 7 Drawing Sheets

MUFFLER AND ITS MANUFACTURING METHOD

This invention relates to a muffler for an internal combustion engine, and also relates to a method of producing the muffler.

BACKGROUND ART

There is known one conventional muffler (particularly sub-muffler) for an internal combustion engine as shown in FIG. 11, in which an outer pipe 102 is mounted around an outer periphery of an inner pipe 100 (which forms an exhaust gas passage), with a space 101 formed therebetween, and one end portion 103 of the outer pipe is fixedly secured to the inner pipe 100 through a buffer member 105 such as a wire mesh, and the other end portion 104 thereof is fixedly secured to the inner pipe 100.

In one known method of producing such a muffler, the one end portion 103 of the outer pipe 102 is first reduced in diameter by a press die 106 as indicated by broken lines in FIG. 12A, and then the inner pipe 100, having the buffer member 105 fitted on one end portion thereof, is inserted into the outer pipe 102 as shown in FIG. 12B, and the buffer member 105 is disposed at the inner peripheral surface of the contracted one end portion 103. Then, as shown in FIG. 12C, the other end portion 104 of the outer pipe 102 is reduced in diameter into a tapering shape by a press die 107, and is fixedly secured to the inner pipe 100.

In the above muffler, generally, the other end portion 108 of the inner pipe 100 remote from the buffer member 105 projects from the contracted other end portion 104 of the outer pipe 102, and serves as a welding portion, and the muffler is connected at this welding portion 108 to an exhaust pipe by welding.

In the above conventional production method, however, that portion of the outer pipe 102, having the buffer member 105, is first reduced in diameter, thereby connecting the inner and outer pipes 100 and 102 together, and therefore during the contraction of the end portion 104 of the outer pipe remote from the buffer member 105, which is effected thereafter, there is a possibility that the inner pipe 100 and the outer pipe 102 are displaced relative to each other in the axial direction.

Namely, the reasons for this are that the strength of frictional connection between the outer pipe 102 and the buffer member 105 is low, and that the outer pipe 102 is pushed in the axial direction by the press die 107.

If the inner and outer pipes are thus displaced relative to each other, a welding area L of the welding portion 108 to be welded to the exhaust pipe is reduced, which results in a problem that it becomes difficult to effect the welding.

Further, the muffler, in which the outer pipe 102 is reduced in diameter by the press die, has a problem that the buffer member 105 can not be compressed uniformly over the entire periphery thereof, and besides in the construction in which the opposite end portions of the outer pipe 102 are reduced in diameter by the press die, the material of the outer pipe can be buckled, and therefore the limit of the contraction rate is about 20%, which leads to a problem that there can not be produced the muffler in which the volume of the space, formed between the inner and outer pipes, is increased.

DISCLOSURE OF THE INVENTION

It is therefore an object of this invention to provide a muffler which solves the above problems, and also to provide a method of producing this muffler.

In order to solve the above problems, the first invention, recited in claim 1, provides a muffler wherein one end portion of an outer pipe, which is mounted around an outer periphery of an inner pipe, with a space formed therebetween, is reduced in diameter to be fixedly secured to the inner pipe, and the other end portion of the outer pipe is reduced in diameter, thereby holding a buffer member between the other end portion of the outer pipe and the inner pipe; CHARACTERIZED in that the reduction of the diameter of at least that end portion, having the buffer member, is effected by spinning.

In this invention, by the spinning processing applied to the outer pipe, the buffer member is compressed uniformly over an entire periphery thereof.

The second invention, recited in claim 2, provides a method of producing a muffler CHARACTERIZED in that the method comprises a first step of holding an inner pipe, having a buffer member fitted on one end portion thereof, within an outer pipe in such a manner that a predetermined gap is formed between the inner and outer pipes; a second step of reducing a diameter of the other end portion of the outer pipe remote from the buffer member, thereby fixedly securing the other end portion to the other end portion of the inner pipe; and a third step of subsequently applying a spinning processing to one end portion of the outer pipe, thereby reducing a diameter of the one end portion until the one end portion is brought into contact with the buffer member, and further radially compresses the buffer member.

In this invention, before that portion, having the buffer member, is reduced in diameter, that portion remote from the buffer member, is reduced in diameter, with the inner and outer pipes held in their respective predetermined positions, thereby fixedly securing the inner and outer pipes to each other, and therefore a welding portion can be accurately formed at this fixed side. And besides, when that portion of the outer pipe, having the buffer member, is to be reduced in diameter by spinning after this fixing operation, the inner and outer pipes can be prevented from being displaced with respect to each other. Furthermore, the reduction of the diameter of that portion of the outer pipe having the buffer member, is effected by the spinning processing in which the outer pipe is rotated, and therefore the outer pipe can be reduced in diameter uniformly over the entire periphery thereof, and also the buffer member is compressed uniformly over the entire periphery thereof.

The third invention, recited in claim 3, is directed to the muffler-producing method, in which the reduction of the diameter of the outer pipe in the second step of the second invention is also effected by spinning processing.

In this invention, an axial load as produced with the use of a die press is not applied to the outer pipe, and the more accurate welding portion can be formed. And besides, the opposite end portions of the outer pipe are both reduced in diameter by spinning processing, and therefore the material thereof will not be buckled at the opposite end portions.

The fourth invention, recited in claim 4, is directed to the muffler-producing method, in which the reduction of the diameter of the outer pipe in the third step of the second or the third invention is effected in such a manner that a mandrel is inserted into one end portion of the outer pipe so as to limit the amount of reduction of the diameter of the outer pipe.

In this invention, the amount of reduction of the diameter of the outer pipe is limited, and therefore the accurate contracted configuration of the outer pipe, as well as the amount of compression of the buffer member, can be obtained easily.

In the fifth invention recited in claim 5, the reduction of the diameter of the outer pipe in the third step is effected in such a manner that a mandrel is inserted into one end portion of the outer pipe so as to limit the amount of reduction of the diameter of the outer pipe and that the mandrel, having a diameter substantially equal to an inner diameter of the inner pipe, is inserted into one end portion of the inner pipe.

In this invention, in addition to the effect of the fourth invention, the inner and outer pipes can be prevented from being crushed and deformed during the reduction of the diameter of the outer pipe.

BEST MODE FOR CARRYING OUT THE INVENTION

The mode for carrying out the present invention will now be described with reference to an embodiment shown in FIGS. 1 to 10.

First, a production apparatus for performing a production method according to the present invention will be described with reference to FIG. 1.

This apparatus includes rotation support means 3 for holding an outer pipe 1 (constructing a muffler) and for rotating the outer pipe about an axis thereof, and the rotation support means 3 comprises a chuck portion 3*a*, which can be closed and opened in such a manner that the chuck portion 3 are divided into a plurality of sections in a circumferential direction, and a rotation portion 3*c* for rotating the chuck portion 3*a* about an axis thereof in one direction A. The showing of drive portions for these portions is omitted.

Figure 1:
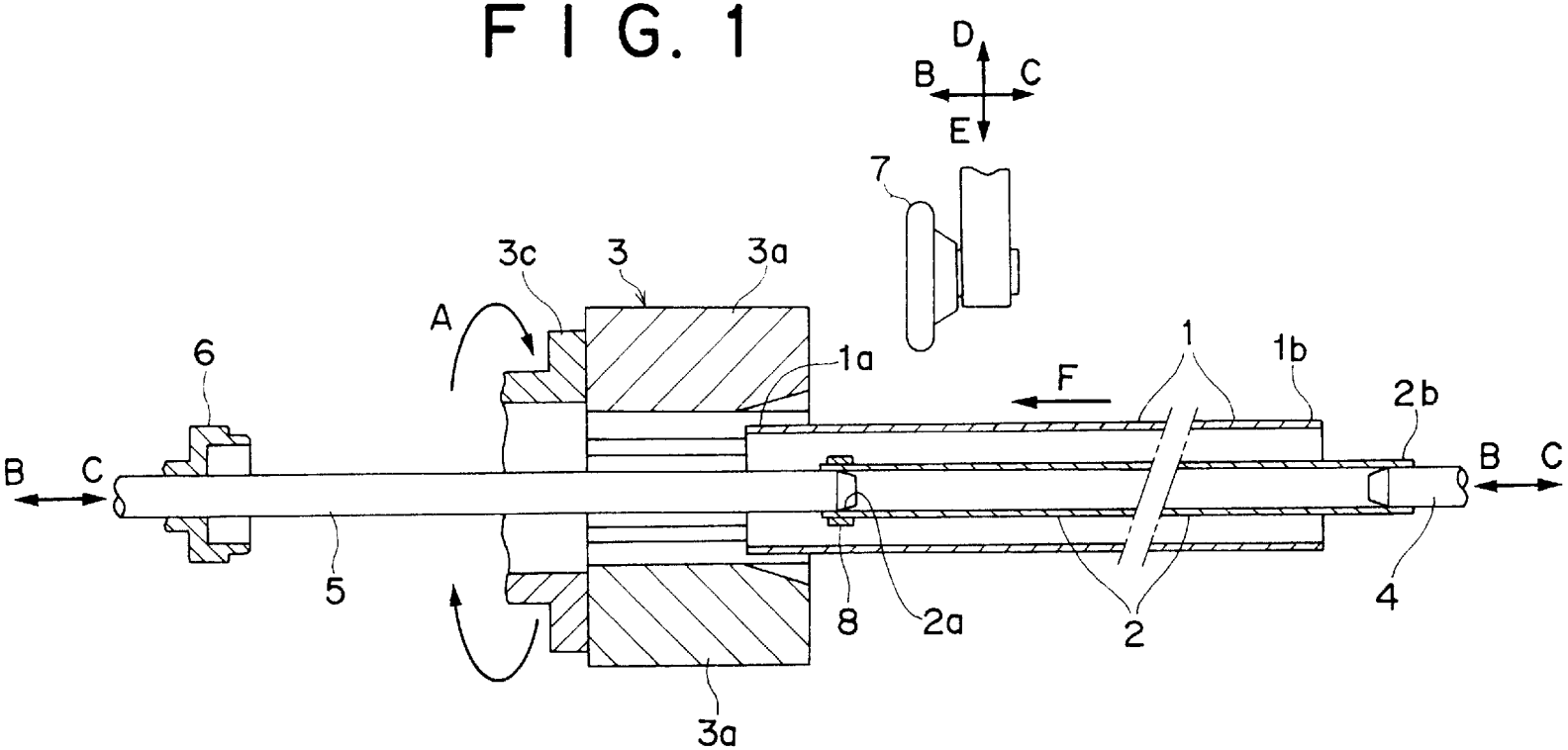
FIG. 1 is a side-elevational, cross-sectional view of an embodiment according to the present invention, showing a condition before inner and outer pipes are supported in their respective predetermined positions.

A first mandrel 4 for fitting into an end portion of an inner pipe 2 (constituting the muffler) to hold this end portion, is provided on one side of the rotation support means 3 in the axial direction, and is disposed in coaxial relation to the rotation support means 3, and the first mandrel can be moved forward and backward in directions of arrows B and C (horizontal direction) in FIG. 1 by drive means (not shown).

A second mandrel 5 for fitting into an end portion of the inner pipe 2 to hold this end portion is provided on the other side of the rotation support means 3 in coaxial relation to the first mandrel 4, and the second mandrel can be moved forward and backward in the directions of arrows B and C in FIG. 1 by drive means (not shown).

A stopper 6 for positioning an end of the outer pipe 1 is mounted on a predetermined portion of the second mandrel 5, and the second mandrel 5 is slidable through the stopper 6.

A spinning roll 7 is provided at that side where the first mandrel 4 is disposed, and the spinning roll 7 can be moved in the directions of arrows B and C (horizontal direction) and directions of arrows D and E (vertical direction) in FIG. 1 by drive means (not shown).

Next, the process for producing the muffler, using the above apparatus, will be described.

Figure 2:
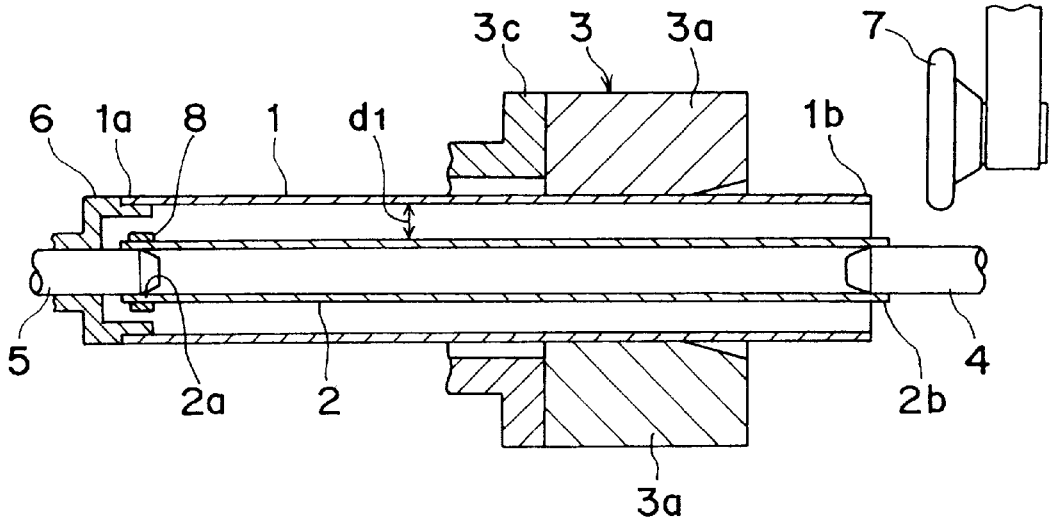
FIG. 2 is a side-elevational, cross-sectional view, showing a condition in which the outer pipe in FIG. 1 is supported in the predetermined position, and the inner pipe is held in the predetermined position within the outer pipe.

First, as shown in FIG. 1, the chuck portion 3*a* is opened, and the outer pipe 1 of a predetermined length is fed in a direction of arrow F by feed means (not shown), and one end portion 1*a* thereof is abutted against the stopper 6, thereby setting the outer pipe in a predetermined position, as shown in FIG. 2, and then the chuck portion 3*a* is closed, thereby supporting the outer pipe 1 by the rotation support means 3.

Also, the second mandrel 5 is moved in the direction of arrow C in FIG. 1, and the two mandrels 4 and 5 are fitted respectively into the opposite end portions of the supplied inner pipe 2 to support the inner pipe 2, as shown in FIG. 1, and then the two mandrels 4 and 5 are moved in the direction of arrow B, so that the inner pipe 2 is held in a predetermined position in the axial direction within the outer pipe 1, with a predetermined gap $d_1$ formed between the inner and outer pipes 1 and 2, as shown in FIG. 2. A buffer member 8, such as a wire mesh, is beforehand fitted on one end portion 2*a* of the inner pipe 2.

Figure 3:
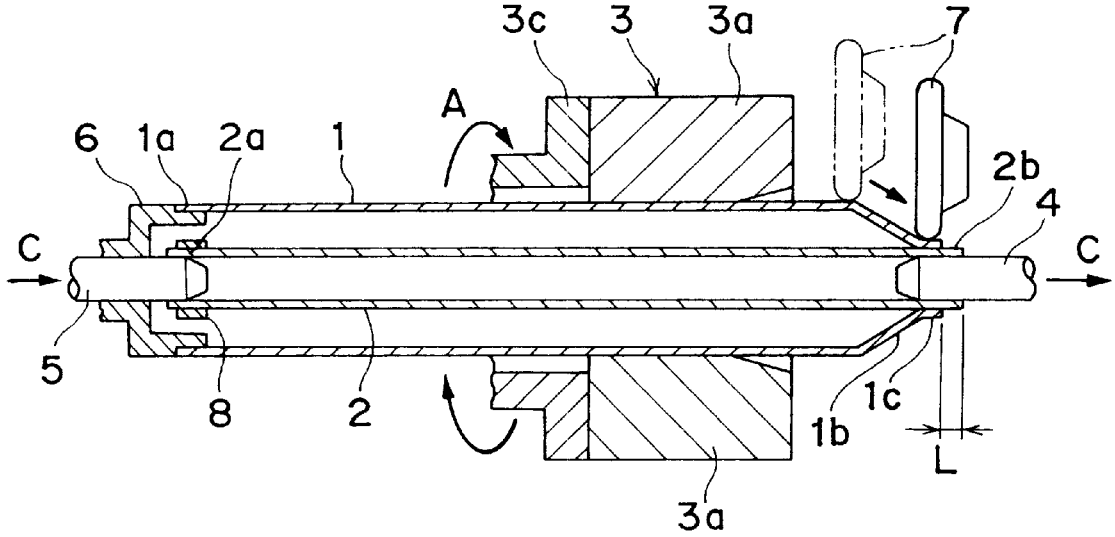
FIG. 3 is a side-elevational, cross-sectional view showing a condition in which the other end portion of the outer pipe in FIG. 2 is reduced in diameter.

Thereafter, as shown in FIG. 3, the other end portion 1*b* of the outer pipe 1 remote from the buffer member 8 is reduced in diameter into a tapered shape (decreasing in diameter progressively toward its distal end) in such a manner that a distal end portion 1*c* of this contracted end portion is pressed against the inner pipe 2 in parallel relation thereto, thereby fixedly securing the outer pipe 1 to the inner pipe 2. This contraction may be effected by a press die with a tapering die surface as in the conventional method. However, in the illustrated embodiment, as shown in FIG. 3, the spinning roll 7 is moved from a position, indicated by broken lines in FIG. 3, to a position, indicated by solid lines, while rotating the rotation support means 3 in the one direction A to rotate the outer pipe 1, thereby contracting or reducing the diameter of the outer pipe 1 by spinning processing.

The contraction of the outer pipe 1 is effected so as to form the distal end portion 1*c* thereof in such a manner that a welding portion L is formed at the other end portion 2*b* of the inner pipe 2. During the contraction of the outer pipe, the inner and outer pipes 2 and 1 are held in their respective predetermined positions, and therefore the welding portion L can be accurately formed.

Figure 4:
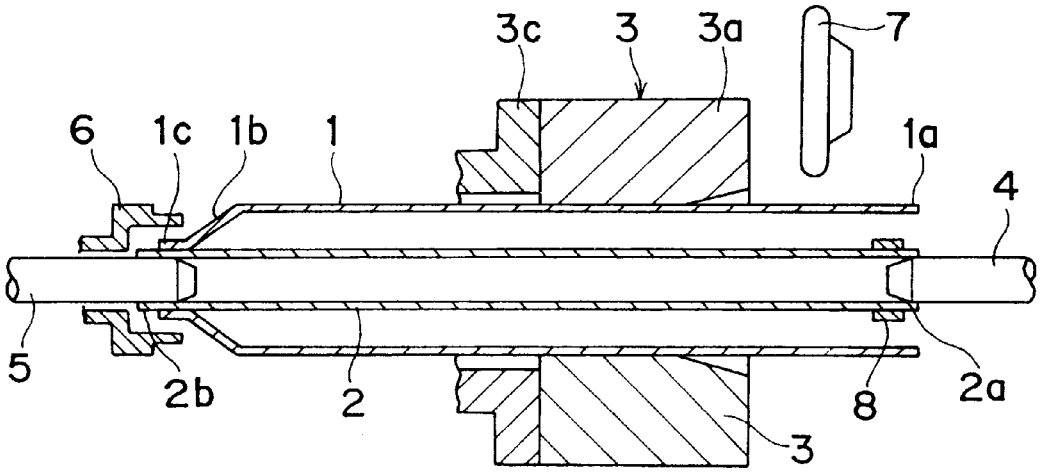
FIG. 4 is a side-elevational, cross-sectional view showing a condition in which the inner and outer pipes in FIG. 3 are inverted in an axial direction.

Thereafter, the chuck portion 3*a* of the rotation support means 3 is opened, and the two mandrels 4 and 5 are moved in the direction of arrow C, thereby drawing and removing the inner and outer pipes 2 and 1 from the rotation support means 3, and the two mandrels 4 and 5 are disengaged, and the inner and outer pipes 2 and 1 are turned so as to reverse the right and left sides, and the two mandrels 4 and 5 are again fitted into the inner pipe 2, and as shown in FIG. 4, the inner and outer pipes 2 and 1 are passed through the rotation support means 3, and the chuck 3*a* is closed to hold the outer pipe 1, thereby setting the inner and outer pipes 2 and 1 in the predetermined position, as shown in FIG. 4.

Figure 5:
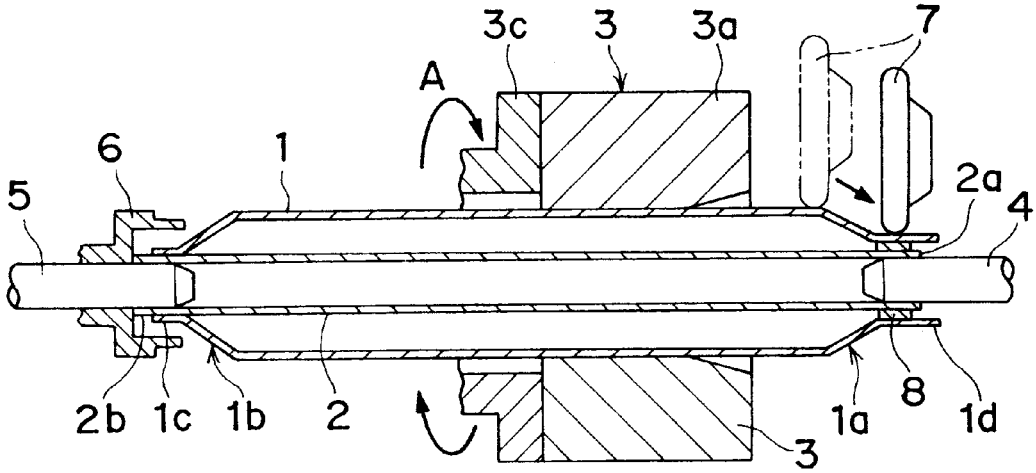
FIG. 5 is a side-elevational, cross-sectional view showing a condition in which one end portion of the outer pipe in FIG. 4 is reduced in diameter.

Thereafter, as shown in FIG. 5, the spinning roll 7 is moved from the position, indicated by broken lines in FIG. 5, to the position, indicated by solid lines, while rotating the rotation support means 3 in the one direction A to rotate the outer pipe 1, thereby contracting or reducing the diameter of the one end portion 1*a* of the outer pipe 1 into a tapered shape (decreasing in diameter progressively toward the distal end) by spinning processing in such a manner that a distal end portion 1*d* of this contracted end portion is pressed against the inner pipe 2 in parallel relation thereto. This contraction is effected until an inner surface of the distal end portion 1*d* of the one end portion 1*a* is brought into contact with the outer surface of the buffer member 8, and further radially compresses the buffer member 8. This contraction operation is effected by the spinning operation, and therefore the contraction can be achieved without applying an axial load as produced with the use of a press die, and the buffer member 8 will not be deformed in the axial direction. And besides, since the spinning operation is effected while rotating the outer pipe 1, the amount of contraction of the outer pipe 1 can be easily controlled, and the contraction can be effected accurately, and the contraction can be effected uniformly over the entire circumference. This means that a desired compression load can be applied uniformly to the buffer member 8 over the entire periphery thereof, and a slide load, which serves to absorb the thermal expansion difference between the inner and outer pipes 2 and 1 during use of the muffler, can be set satisfactorily.

Figure 6:
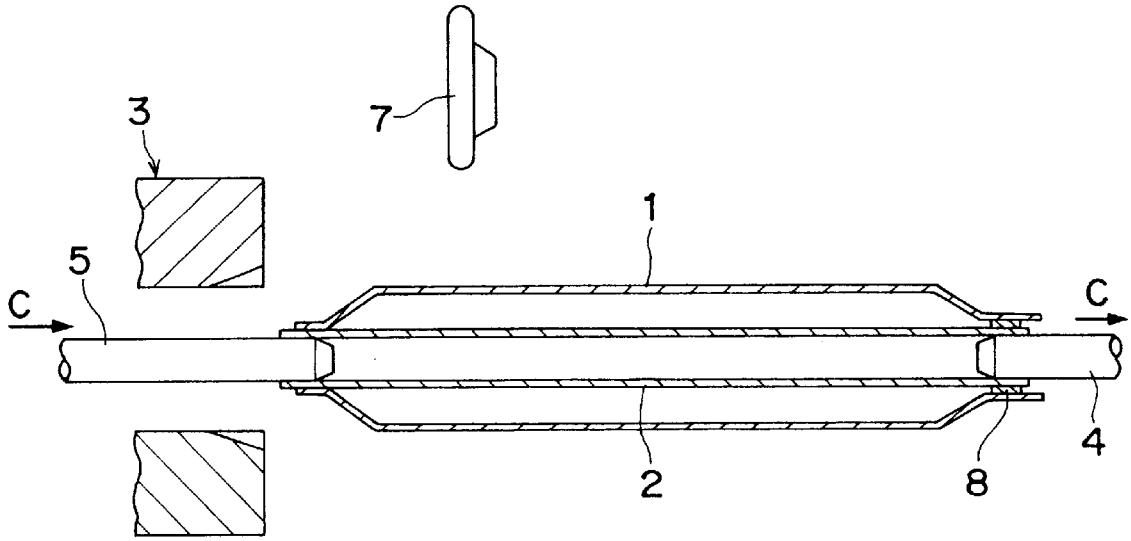
FIG. 6 is a side-elevational, cross-sectional view showing a condition in which the inner and outer pipes in FIG. 5 are drawn and removed.

Then, after the above contraction operation, the chuck 3*a* is opened, and the two mandrels 4 and 5 are moved in the direction of arrow C, and the inner and outer pipes 2 and 1 are drawn and removed from the rotation support means 3, as shown in FIG. 6.

Figure 7:
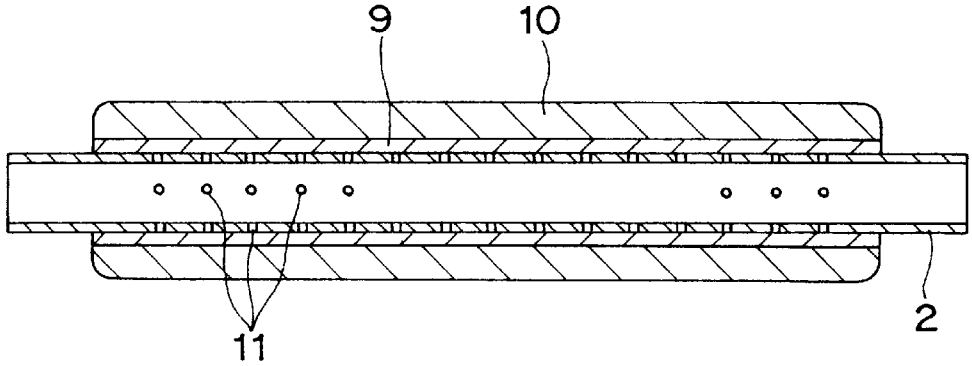
FIG. 7 is a side-elevational, cross-sectional view of the inner pipe on which wire mesh and glass wool are wound.
Figure 8A:
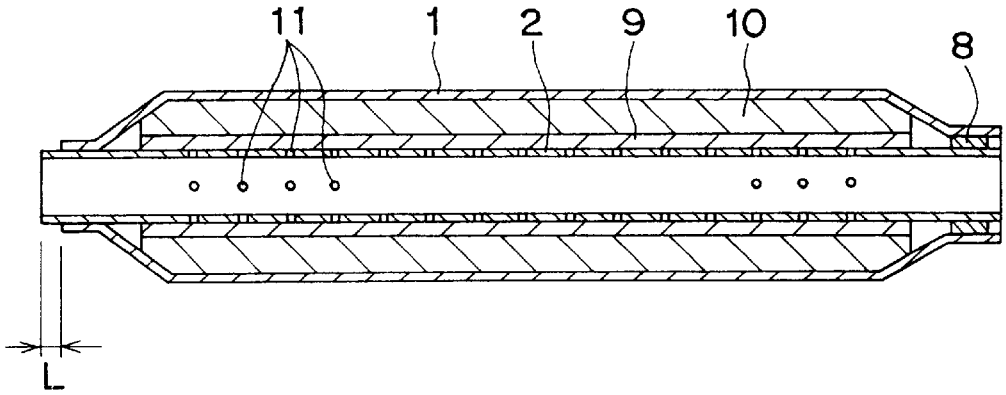
FIGS. 8A and 8B show a muffler produced in accordance with the present invention, FIG. 8A being a side-elevational, cross-sectional view, and FIG. 8B being a vertical cross-sectional view of FIG. 8A.
Figure 8B:
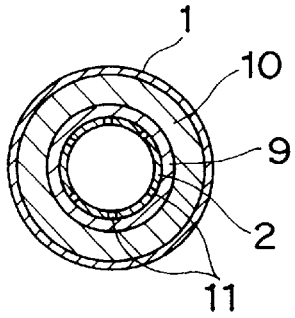

Although the showing of muffler members, interposed between the inner and outer pipes 2 and 1, is omitted from FIGS. 1 to 6 for the purpose of avoiding the complexity of the drawings, the muffler members are actually interposed, and in the present invention, before the step of FIG. 1, stainless wool 9 is wound on the outer periphery of the inner pipe 2, and glass wool 10 is wound on the outer periphery of the stainless wool, as shown in FIG. 7. Many holes 11 are formed in the inner pipe 2 as shown in FIG. 7. FIGS. 8A and 8B show the muffler produced by the above process, using the inner pipe 2 having the stainless wool 9 and the glass wool 10 wound thereon.

Figure 9:
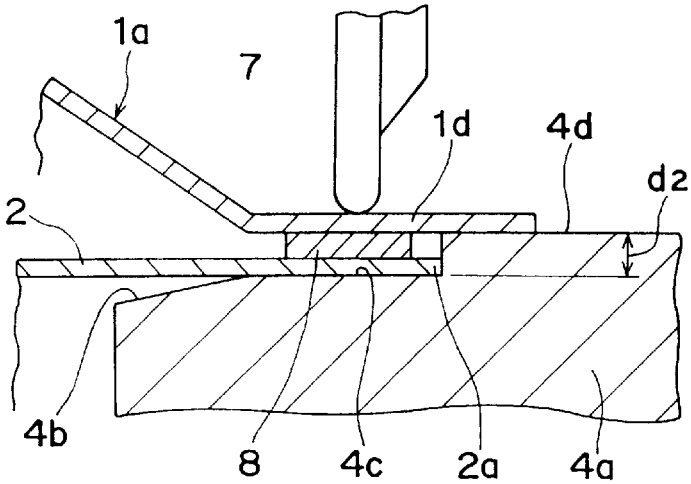
FIG. 9 is a side-elevational, cross-sectional view showing another example of a mandrel of the present invention.

FIG. 9 shows another example of the first mandrel 4 used in the step of FIG. 5.

Figure 10:
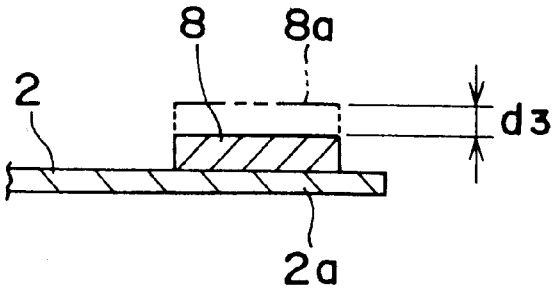
FIG. 10 is a cross-sectional view showing the amount of compression of a buffer member.
Figure 11:
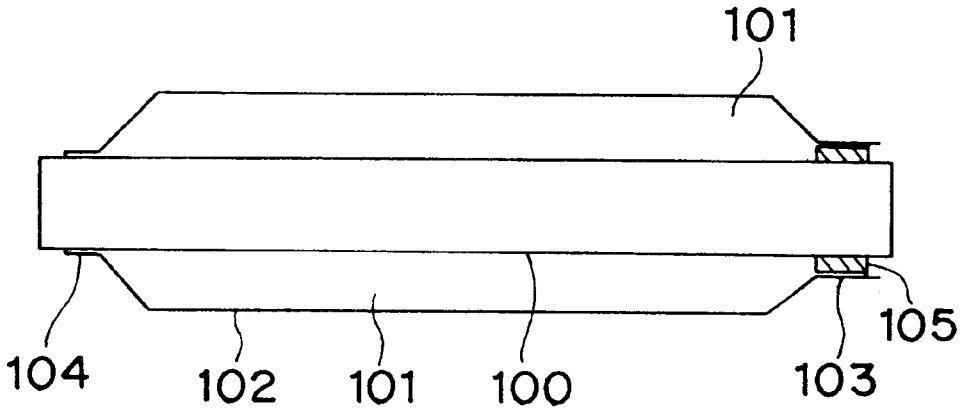
FIG. 11 is a side-elevational, cross-sectional view showing a muffler.
Figure 12A:
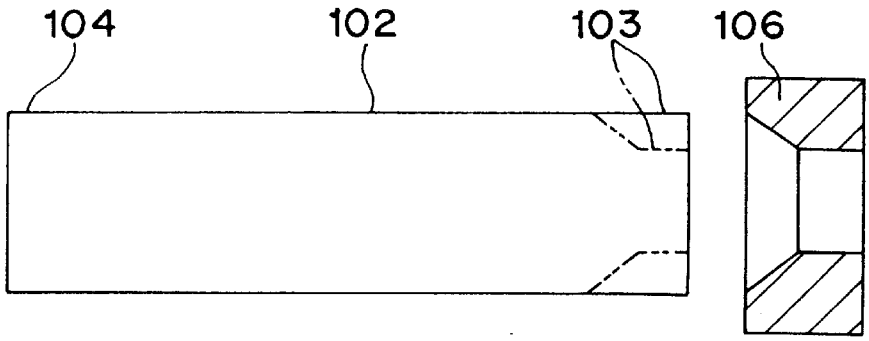
FIGS. 12A to 12C are views showing the steps of a conventional production method.
Figure 12B:
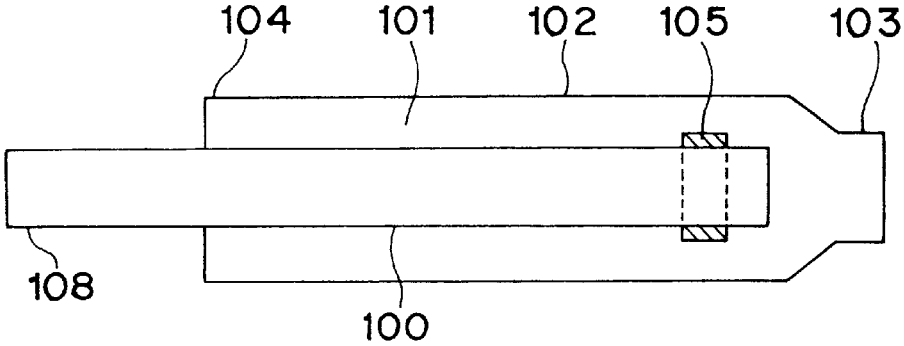
Figure 12C:
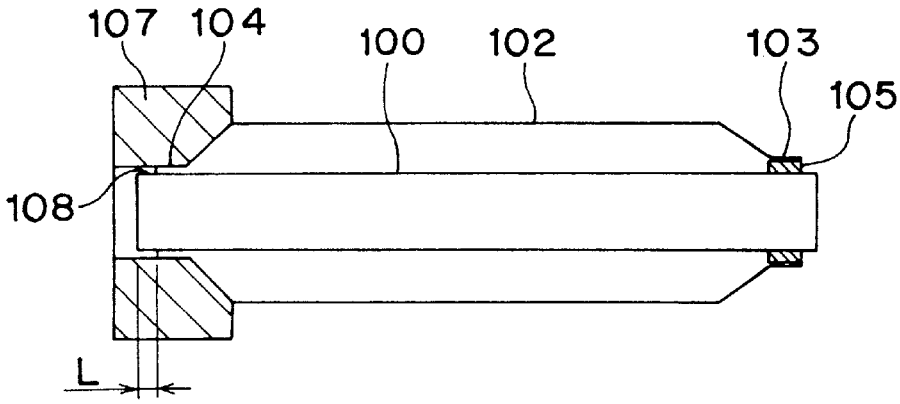

A tapering surface 4*b*, which is smaller in diameter than the inner diameter of the inner pipe 2, and is decreasing in diameter progressively toward a distal end surface of this first mandrel 4*a* from a rear portion thereof, is formed at the distal end portion of the first mandrel 4*a*, and an inner pipe-fitting surface 4*c*, having a diameter equal to the inner diameter of the inner pipe 2, is formed on that portion disposed rearwardly of the tapering surface 4*b*, and an outer pipe-fitting surface 4*d*, having a diameter equal to the inner diameter of the outer pipe 1, is formed on that portion disposed rearwardly of the inner pipe-fitting surface 4*c*. A step $d_2$ between the inner pipe-fitting surface 4*c* and the outer pipe-fitting surface 4*d* is set to a length matched to a compression amount $d_3$ by which the buffer member 8 is compressed and contracted from an unprocessed condition, indicated by a broken line, into a predetermined thickness indicated by a solid line, as shown in FIG. 10.

When the contraction operation of FIG. 5 is effected using this mandrel 4*a*, the amount of contraction of the distal end portion 1*d* of the one end portion 1*a* of the outer pipe can be limited by the outer pipe-fitting surface 4*d*, so that the contraction can be achieved accurately, and besides the accurate compression rate of the buffer member 8 can be obtained by the step $d_2$. Furthermore, the crushing of the inner and outer pipes due to an excessive pressure, applied by the spinning roll 7, can be prevented.

Although the above embodiment is directed to the example in which the opposite end portions of the outer pipe 1 are reduced in diameter by the spinning operation, there may be used an arrangement in which at least that end portion of the outer pipe 1, having the buffer member 8, is subjected to the spinning processing whereas the other end portion is reduced in diameter by other means such as a press die. Even when only that end portion, having the buffer member 8, is thus reduced in diameter by spinning processing, there can be achieved the effect of applying a desired compression load to the buffer member 8 over the entire periphery thereof.

When the opposite end portions of the outer pipe 1 are both reduced in diameter by spinning processing, the material will not be buckled at the opposite end portions, and therefore the contraction rate can be made larger than that of 20% obtained by the conventional method, and the volume of the space between the outer pipe 1 and the inner pipe 2 can be increased. Therefore, the degree of freedom of the design is increased.

In the above embodiment, although the opposite end portions of the outer pipe are contracted in diameter only by spinning processing, there may be used an arrangement in which the initial contraction is effected by a press die or the like, and then the contraction is completed by spinning processing.

INDUSTRIAL APPLICABILITY

As described above, in the invention recited in claim 1, there can be provided the muffler in which a desired compression load can be applied to the buffer member uniformly over the entire periphery thereof, and a slide load, which serves to absorb the thermal expansion difference between the inner and outer pipes during use of the muffler, can be set satisfactorily.

In the invention recited in claim 2, the welding portion can be accurately formed at that portion remote from the buffer member, and besides the inner and outer pipes can be prevented from being displaced with respect to each other, so that the accurate contracted configuration can be obtained. Furthermore, that portion of the outer pipe, having the buffer member, can be reduced in diameter in a desired amount uniformly over the entire periphery thereof. Therefore, a desired compression load can be applied uniformly to the buffer member over the entire periphery thereof, and a slide load, which serves to absorb the thermal expansion difference between the inner and outer pipes during use of the muffler, can be set satisfactorily.

In the invention recited in claim 3, the more accurate welding portion can be formed, and besides the material of the opposite end portions, reduced in diameter, will not be buckled, and therefore the contraction rate can be made larger than that of 20%, obtained by the conventional method, and the volume of the space between the outer pipe 1 and the inner pipe 2 can be increased. Therefore, the degree of freedom of the design is increased.

In the invention recited in claim 4, the accurate contracted configuration of the outer pipe, as well as the amount of compression of the buffer member, can be obtained easily.

In the invention recited in claim 5, the inner and outer pipes can be prevented from being crushed and deformed during the reduction of the diameter of the outer pipe.

What is claimed is:

1. A method of producing a muffler wherein said method comprises a first step of holding an inner pipe, having a buffer member fitted on one end portion thereof, within an outer pipe, held in position, in such a manner that a predetermined gap is formed between said inner and outer pipes; a second step of reducing a diameter of the other end portion of said outer pipe remote from said buffer member, thereby fixedly securing said other end portion of the outer pipe to the other end portion of said inner pipe; and a third step of subsequently applying a spinning processing to one end portion of said outer pipe, thereby reducing a diameter of said one end portion of the outer pipe until said one end portion of the outer pipe is brought into contact with said buffer member, and further radially compresses said buffer member.

2. A method of producing a muffler according to claim 1, in which the reduction of the diameter of the outer pipe in said second step is also effected by spinning processing.

3. A method of producing a muffler according to claim 1 or claim 2, in which the reduction of the diameter of said outer pipe in said third step is effected in such a manner that a mandrel is inserted into the one end portion of said outer pipe so as to limit the amount of reduction of the diameter of said outer pipe.

4. A method of producing a muffler according to claim 1 or claim 2, in which the reduction of the diameter of said outer pipe in said third step is effected in such a manner that a mandrel is inserted into the one end portion of said outer pipe so as to limit the amount of reduction of the diameter of said outer pipe and that the mandrel, having a diameter substantially equal to an inner diameter of said inner pipe, is inserted into the one end portion of said inner pipe.

* * * * *